US009219322B1

(12) United States Patent
Wei et al.

(10) Patent No.: US 9,219,322 B1
(45) Date of Patent: Dec. 22, 2015

(54) UNDER MOUNTED LEAF SPRING CONNECTOR

(71) Applicant: Amazon Technologies, Inc., Reno, NV (US)

(72) Inventors: Eric Jeffrey Wei, Sunnyvale, CA (US); Nidhi Rathi, Sunnyvale, CA (US)

(73) Assignee: Amazon Technologies, Inc., Reno, NV (US)

( * ) Notice: Subject to any disclaimer, the term of this patent is extended or adjusted under 35 U.S.C. 154(b) by 316 days.

(21) Appl. No.: 13/865,027

(22) Filed: Apr. 17, 2013

(51) Int. Cl.
*H01R 4/48* (2006.01)
*H01R 13/17* (2006.01)
*H01R 43/00* (2006.01)

(52) U.S. Cl.
CPC ..... *H01R 13/17* (2013.01); *H01R 43/00* (2013.01)

(58) Field of Classification Search
CPC .... H01R 11/282; H01R 11/281; H01R 11/22; H01R 11/28
USPC ..... 439/759, 676, 65–66, 816, 91, 591, 700
See application file for complete search history.

(56) References Cited

U.S. PATENT DOCUMENTS 5,066,235 A * 11/1991 Kobayashi ..... 439/76.1
5,259,769 A * 11/1993 Cruise et al. ..... 439/65
6,752,634 B2 * 6/2004 Gonzalez et al. ..... 439/66
6,851,986 B2 * 2/2005 Zhao ..... 439/744

* cited by examiner

*Primary Examiner* — Edwin A. Leon
(74) *Attorney, Agent, or Firm* — Lowenstein Sandler LLP

(57) ABSTRACT

An apparatus includes a support structure and a leaf spring connector coupled to the support structure. The leaf spring connector has a working height measured from a first surface of the two-sided support structure to a mating surface of the leaf spring connector when the leaf spring connector is in a compressed position. The leaf spring connector is mounted below the first surface of the support structure in order to reduce the working height of the leaf spring connector by at least a portion of a thickness of the support structure.

20 Claims, 10 Drawing Sheets

UNDER MOUNTED LEAF SPRING CONNECTOR

BACKGROUND

A large and growing population of users enjoy entertainment through the consumption of digital media items, such as music, movies, images, electronic books, and so on. Users employ various electronic devices to consume such media items. Among these electronic devices are electronic book readers, cellular telephones, personal digital assistants (PDAs), portable media players, tablet computers, netbooks, and the like.

These electronic devices often use include connectors used to couple electrical components of the electronic device. Positioning these connectors during manufacture of the electronic device can be difficult. In addition, the connectors are often placed in compact locations where space is at a premium. In some cases, the connectors have a fixed size and require a certain amount of space in order to fit and function properly. If the space between components is not large enough to accommodate certain connectors, those connectors may not be used. This may result in the manufacturer resorting to the use of more expensive or less readily available connectors, or increasing the size of the electronic device.

BRIEF DESCRIPTION OF THE DRAWINGS

Embodiments of the present invention will be understood more fully from the detailed description given below and from the accompanying drawings, which, however, should not be taken to limit the present invention to the specific embodiments, but are for explanation and understanding only.

DETAILED DESCRIPTION

Embodiments of a method and apparatus are described for leaf spring connector mounted to a support structure. In one embodiment, the leaf spring connector is mounted to a support structure, such as a printed circuit board (PCB), in order to form an electrical connection between one or more electrical components mounted on the PCB, such as a chip, and an external component not mounted directly on the PCB, such as a battery. In other embodiments, the external component may be any other component that is to be connected to one or more components on the PCB. The leaf spring connector may be part of a connector assembly that also includes a connector housing. In other embodiments, the leaf spring connector may not include the housing. In one embodiment, the external component may be located adjacent to a first (e.g., top) side of the PCB. The top side of the PCB may be, for example, a surface where all or a majority of electrical components are mounted. In that case, the leaf spring connector may be mounted to a second (e.g., bottom) side of the PCB and extend through a notch or other opening in the PCB and past the first side. The leaf spring connector may make contact with the external component to form the electrical connection on the first side of the PCB. The leaf spring connector may be connected to a conductive trace on the PCB that routes electrical signals to the other electrical components on the PCB. In other embodiments, the leaf spring connector may be mid-mounted within the PCB between the first side and the second side of the PCB.

By mounting the leaf spring connector to a side of the PCB opposite where it will contact the external component (i.e., under mounting the connector) an effective working height of the leaf spring connector may be reduced. The leaf spring connector may have a minimum height that is required for the spring to mechanically operate. In some cases, due to space restrictions, the amount of clearance space on one side of the PCB may be less than the working height. Thus, if the leaf spring connector were to be mounted to that side of the PCB, it would not fit. When the leaf spring connector is mounted below the first side of the PCB, the effective height of the spring above the first side of the PCB is reduced, thereby allowing the leaf spring connector to be used in a location with space constraints.

Figure 1:
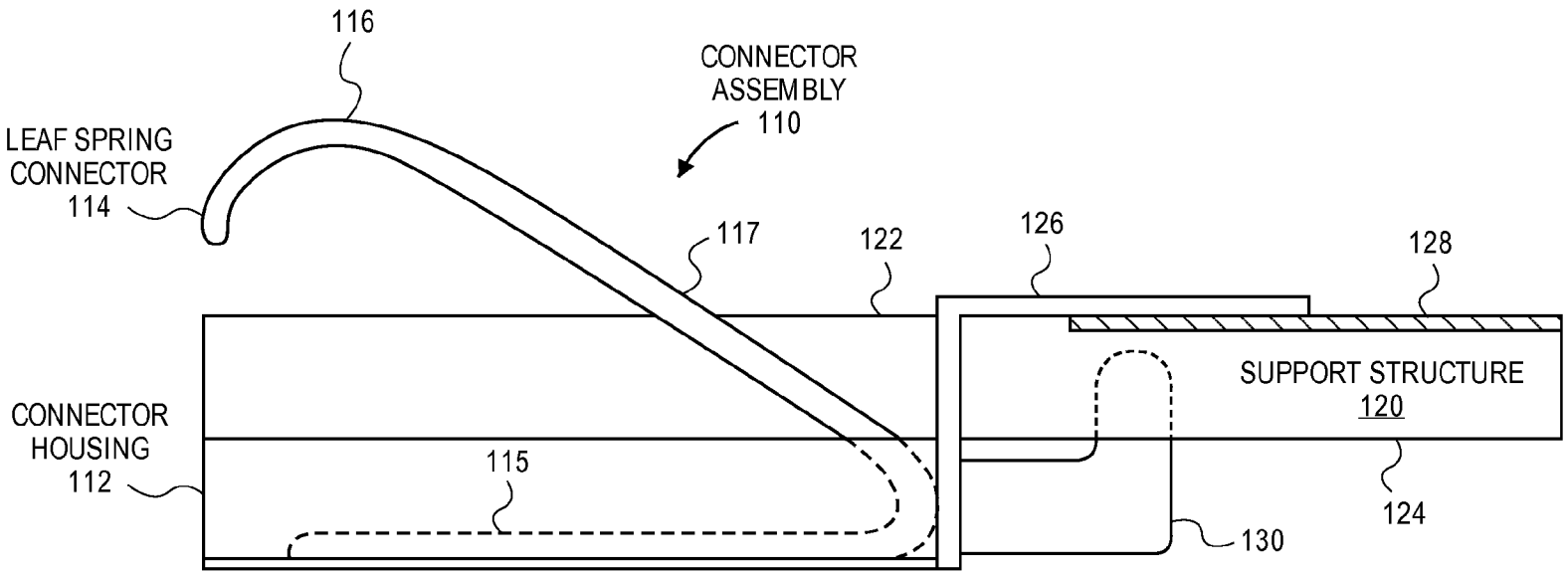
FIG. 1 is a block diagram illustrating a cross-sectional view of an under mounted leaf spring connector assembly, according to an embodiment.

FIG. 1 is a block diagram illustrating a cross-sectional view of an under mounted leaf spring connector assembly 110, according to an embodiment. The leaf spring connector assembly 110 includes connector housing 112 and the leaf spring connector 114 itself. In one embodiment, the leaf spring connector assembly 110 is mounted to a support structure 120. The support structure 120 may include, for example a two-sided printed circuit board (PCB) having a first side 122 and a second side 124. As illustrated, the leaf spring connector assembly 110 is mounted to the second side 124 of the support structure 120. This second side 124 is opposite the first side 122, which is where the leaf spring connector 114 is designed to couple to an external component, such as a battery. In one embodiment, the leaf spring connector 114 extends through a notch in the support structure 120 and extends above the first side 122. In another embodiment, the leaf spring connector assembly 110 is mounted at some level below the first side 122 of support structure 120. In other embodiments, the leaf spring connector assembly 110 may be mounted to the first side 122, when the leaf spring connector 114 is intended to couple to an external component adjacent to the opposite second side 124 of support structure 120.

In one embodiment, the leaf spring connector 114 is formed from a single piece of conductive material, such as stamped sheet metal. The conductive material is shaped to include a support contact surface 115, a mating surface 116 and a curved spring arm 117 to connect support contact surface 115 and mating surface 116. In one embodiment, support contact surface 115 is substantially flat in shape and extends below mating surface 116 and spring arm 117. In another embodiment, support contact surface 115 extends away from the rest of leaf spring connector 114, such that it is not located below mating surface 116 or spring arm 117. In one embodiment, mating surface 116 is curved in shape in order to form a contact with a variety of external components. In one embodiment, spring arm 117 is curved such that mating surface 116 is located approximately above support contact surface 115. In another embodiment, spring arm 117 is substantially straight.

In one embodiment, the support contact surface 115 contacts housing trace 126. In turn, housing trace 126 contacts conductive trace 128 on the first side 122 of support structure 120. Conductive trace 128 may additionally be coupled to one or more electrical components (not shown) mounted to support structure 120. Thus, housing trace 126 forms an electrical connection between leaf spring connector 114 and conductive trace 128. Traces 126 and 128 may be designated signal lines formed from a conductive material, such as copper, some other metal, conductive ink, etc. Thus, the combination of leaf spring connector 114, housing trace 126 and conductive trace 128, may form an electrical connection between an external component (not shown) that is coupled to mating surface 116 of leaf spring connector 114 and an electrical component mounted to support structure 120. In another embodiment, leaf spring connector 114 may be directly connected to conductive trace 128 or may be connected to conductive trace 128 through one or more other intermediate elements.

In one embodiment, connector housing 112 is connected to support structure 120 using one or more mounting elements 130. The mounting elements 130 may be affixed to connector housing 112 and extend within support structure 120, as shown. The mounting elements 130, for example, may be metal or plastic posts that are soldered to support structure 120. In other embodiments, the mounting elements 130 may be screws, snap connectors, or some other connector that attaches to support structure 120 to hold connector housing 112 in place. In one embodiment, the mounting elements 130 can be used as housing trace 126 to form an electrical connection between leaf spring connector 114 and conductive trace 128.

Figure 2:
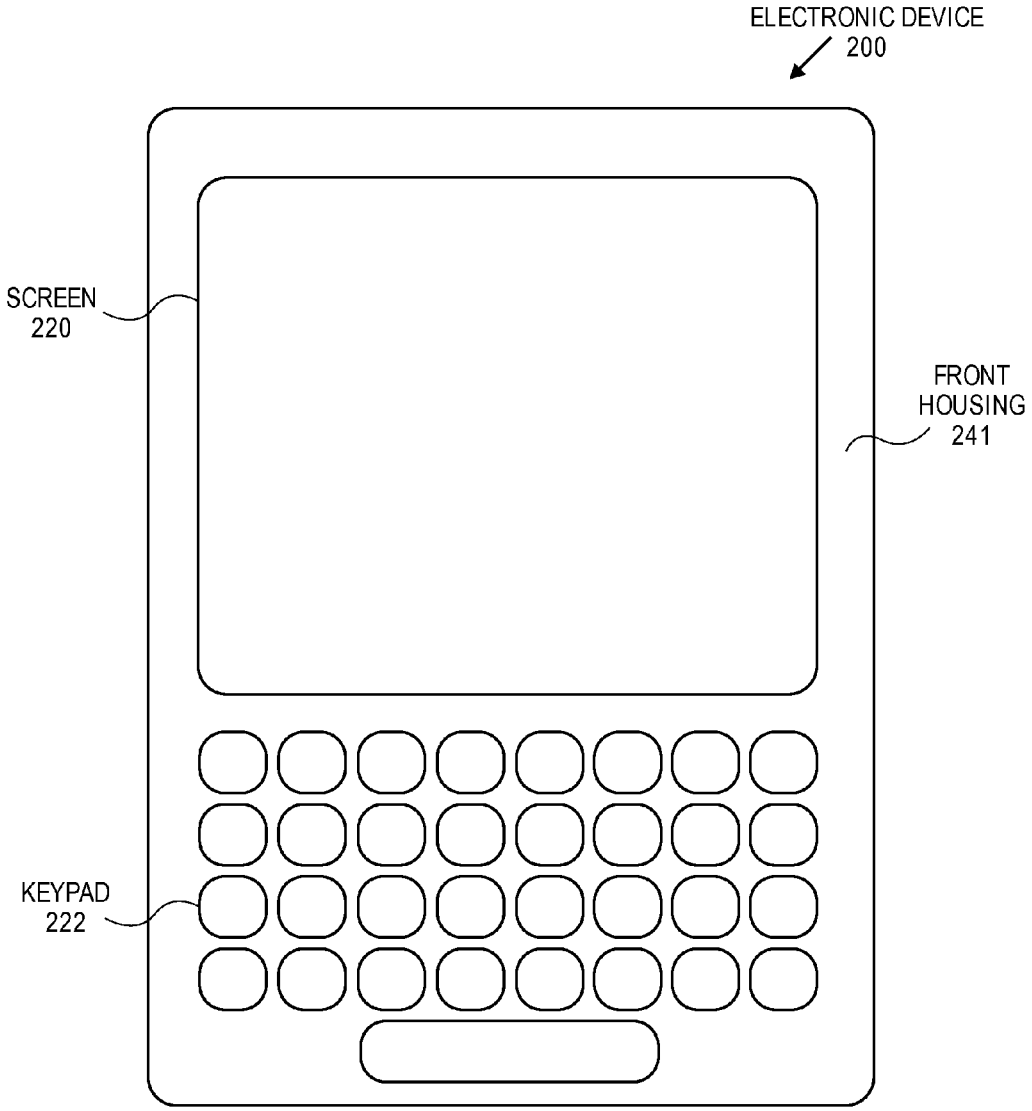
FIG. 2 is a block diagram illustrating a front view of an electronic device, according to an embodiment.
Figure 3:
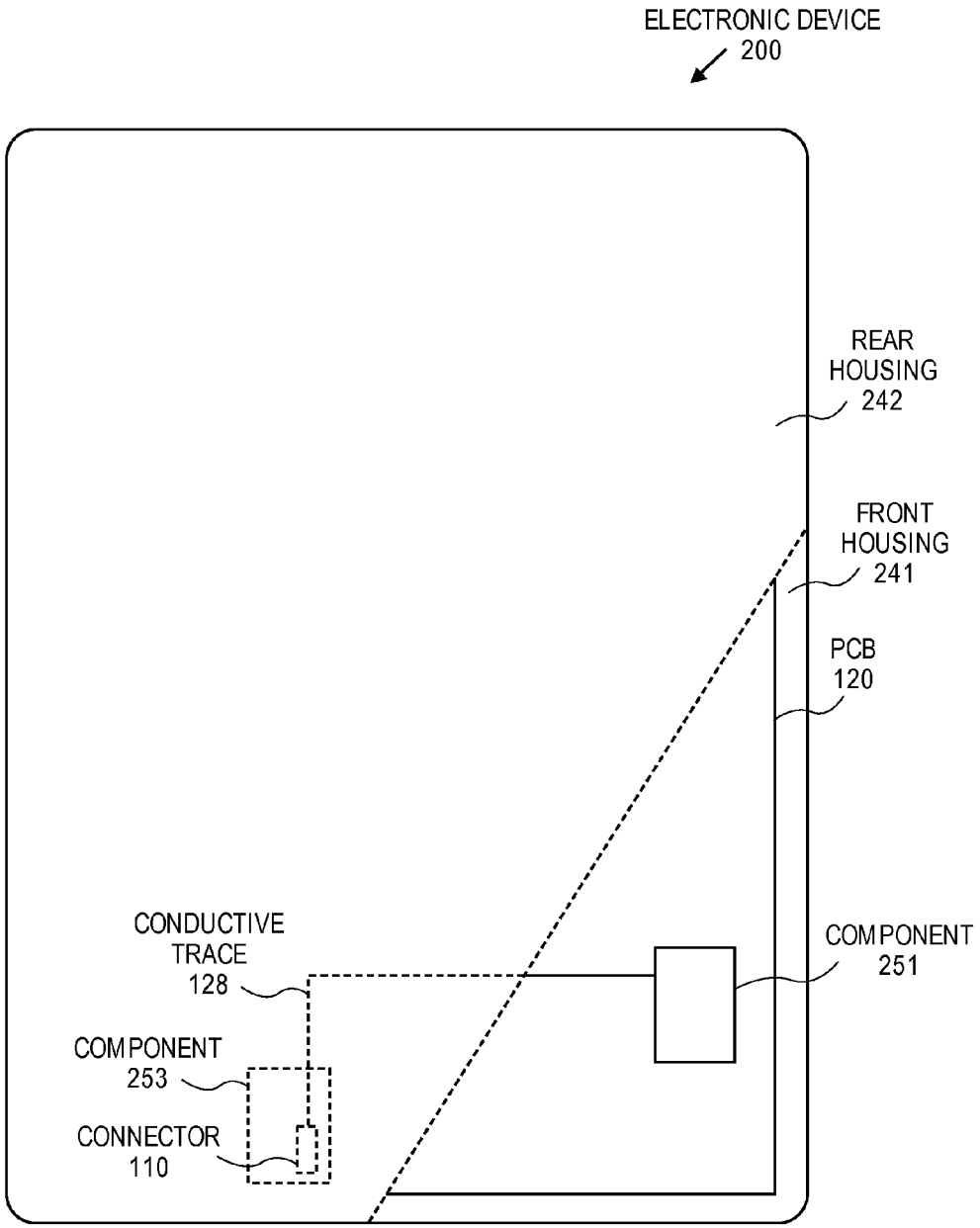
FIG. 3 is a block diagram illustrating a partially cutaway back view of an electronic device, according to an embodiment.

As noted above, the leaf spring connector assembly 110 may be used to couple electrical components on support structure 120 to an external component. FIG. 2 illustrates a front view of an embodiment of an electronic device 200. FIG. 3 illustrates a partially cutaway back view of the electronic device 200. The electronic device 200 may include, for example, an electronic book reader, a cellular telephone, a personal digital assistant (PDAs), a portable media player, a tablet computer, a netbook, or any portable, compact electronic device.

The electronic device 200 may include a screen 220 which can display text, images, or other media. In particular, the screen 220 may comprise a liquid crystal display (LCD), an electrophoretic ink (E ink) screen, an interferometric modulator (IMod) screen, or any another type of display. The screen 220 may include a plurality of pixels arranged in a grid having parameters that are individually configurable by the electronic device. For example, the electronic device 200 may be configured to adjust the color and/or brightness of individual pixels so as to display an image, text, or other media.

The electronic device 200 may include a front housing 241 which at least partially surrounds and protects the internal components of the electronic device 200, such as those described below with respect to FIG. 9. The front housing 241 may include openings through which output devices, such as the screen 220 can transmit information to a user and through which input devices, such as the keypad 222, can receive information from a user. In one embodiment, the front housing 241 is composed of plastic. In other embodiments, the front housing 241 is composed of other materials.

The electronic device 200 includes a rear housing 242 opposite the front housing 241 which partially surrounds and protects the internal components of the electronic device 200. In one embodiment, the rear housing 242 is coupled to the front housing 241 to create a complete housing for the electronic device 200. Although the front housing 241 and rear housing 242 are described as separate components, it is to be appreciated that the housing may be formed as a single component or using more than two components.

In one embodiment, the housing surrounds support structure 120, such as a printed circuit board (PCB), of the electronic device 200. The PCB 120 may have one or more electrical components 251 attached thereto, including, for example, a resistor, a switch, a circuit, a chip, a processing device, a storage device, or some other component. In one embodiment, the PCB 120 may include one or more conductive traces 128 that couple various other components of the PCB 120 together. In addition, other components not described above may be attached to the PCB 120.

Although embodiments are described herein with respect to a printed circuit board (PCB) 120 as a support structure, it is to be appreciated that other embodiments may involve other support structures, such as a logic board, a motherboard, an analog board, a substrate, a frame, such as an internal frame or a midframe, or other support structures. The support structure may be composed of metal, plastic, or a combination of metal and plastic. In other embodiments, the support structure may be other types or composed of other materials.

The electronic device 200 may include one or more connector assemblies 110, each having one or more leaf spring connectors 114, that may be attached to the PCB 120. The connector assembly 110 may be coupled, for example, to conductive trace 128, or component 251. The connector assembly 110 may be coupled, via a conductive trace 128, to a component 251. The leaf spring connector 114 within connector assembly 110 may be electrically coupled to another component 253, which may be attached, for example to a part of the housing, such as front housing 241 or rear housing 242. In another embodiment, the component 253 may be attached to some other support structure within electronic device 200 rather than the housing. The component 253 may include, for example, a rechargeable battery for storing energy that is used to power the electronic device 200. In other embodiments, the component 253 may be some other component, such as a speaker, an antenna, a peripheral connector, or some other component. Connector assembly 110 thus forms an electrical connection between the component 253 and conduction trace 128 on PCB 120, which in one embodiment, leads back to component 251.

Figure 4:
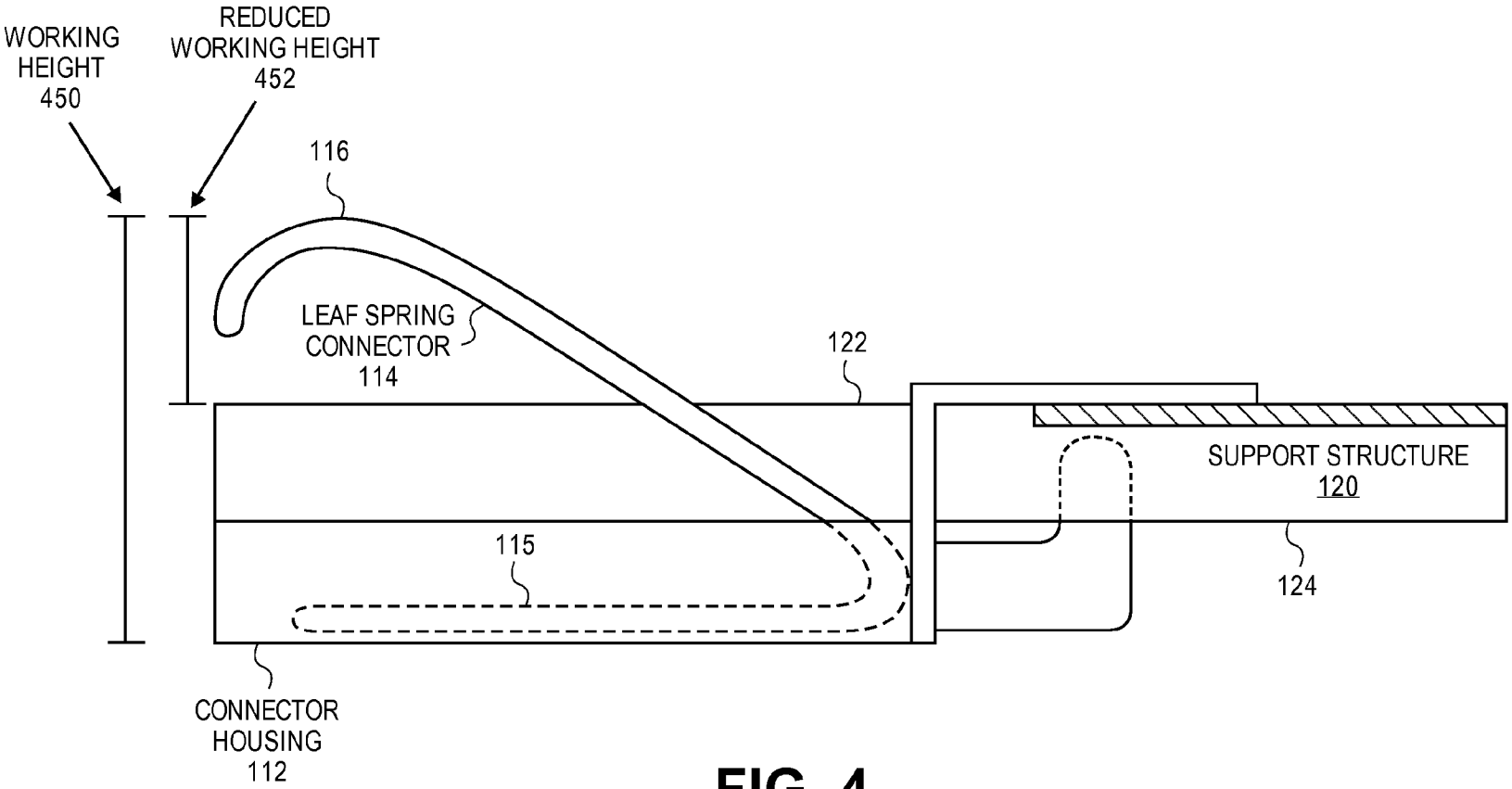
FIG. 4 is a block diagram illustrating a cross-sectional view of the working height of an under mounted leaf spring connector, according to an embodiment.

FIG. 4 is a block diagram illustrating a cross-sectional view of the working height of an under mounted leaf spring connector, according to an embodiment. In one embodiment, as described above, connector housing 112 is mounted to the second side 124 of support structure 120. Leaf spring connector 114 resides at least partially within connector housing 112 and extends through a notch in support structure 120 extending at least partially beyond the first side 122 of support structure 120.

Leaf spring connector 114 has a defined working height 450 that may be dependent on its manufacture. In one embodiment, the working height 450 is defined as the minimum distance between the bottom of the support contact surface 115 and the top of the mating surface 116, when the spring is in a fully compressed position. Thus, the working height 450 is representative of the space into which the leaf spring connector can fit, when fully compressed. In an embodiment, where leaf spring connector 114 is mounted to the first side 122 of support structure 120, the leaf spring connector 114 would extend above the first side 122 by the working height 450. Consequently, a clearance space equal to at least the working height 450 is needed above the first surface 122. The clearance space may be limited, for example, by the front or rear housings 241, 242 of electronic device 200 and by the presence of any external components 253 located adjacent to support structure 120. In some embodiments, the clearance space may be limited to the extent that the clearance space is less than the working height distance 450 above the first side 122 of the support structure 120.

In the illustrated embodiment, connector housing 112 is mounted to the second side 124 of support structure and leaf spring connector 114 extends through a notch in support structure 120. While the true working height 450 of the leaf spring connector 114 does not change (since it is a static value associated with the mechanical manufacture of the spring), the effective working height 452 may be reduced. The leaf spring connector 114 still has the ability to compress through the notch in support structure 120, but as illustrated, the portion of the leaf spring connector 114 that extends above the first side 122 of support structure is reduced. In one embodiment, the reduced effective working height 452 of the leaf spring connector 114 may be measured from the first side 122 of support structure 120 to the top of the mating surface 116, when the leaf spring connector 114 is in a compressed position. Thus, the working height may be reduced by at least a thickness of support structure 120. In this mounting position, the leaf spring connector 114 may be used in a situation where the clearance space above the first side 122 of support structure 120 is less than the working height 450.

In another embodiment, where the connector housing 112 is mounted not to the second side 124, but somewhere between the first side 122 and the second side 124 (i.e., within the notch in support structure 120), the working height may still be reduced to some extent. In this embodiment, the effective working height 452 may be less than the working height 450 by at least a portion of the thickness of support structure 120, rather than the full thickness. Depending on the clearance space, however, this reduced working height 452 may still allow the leaf spring connector 114 to be used.

Figure 5:
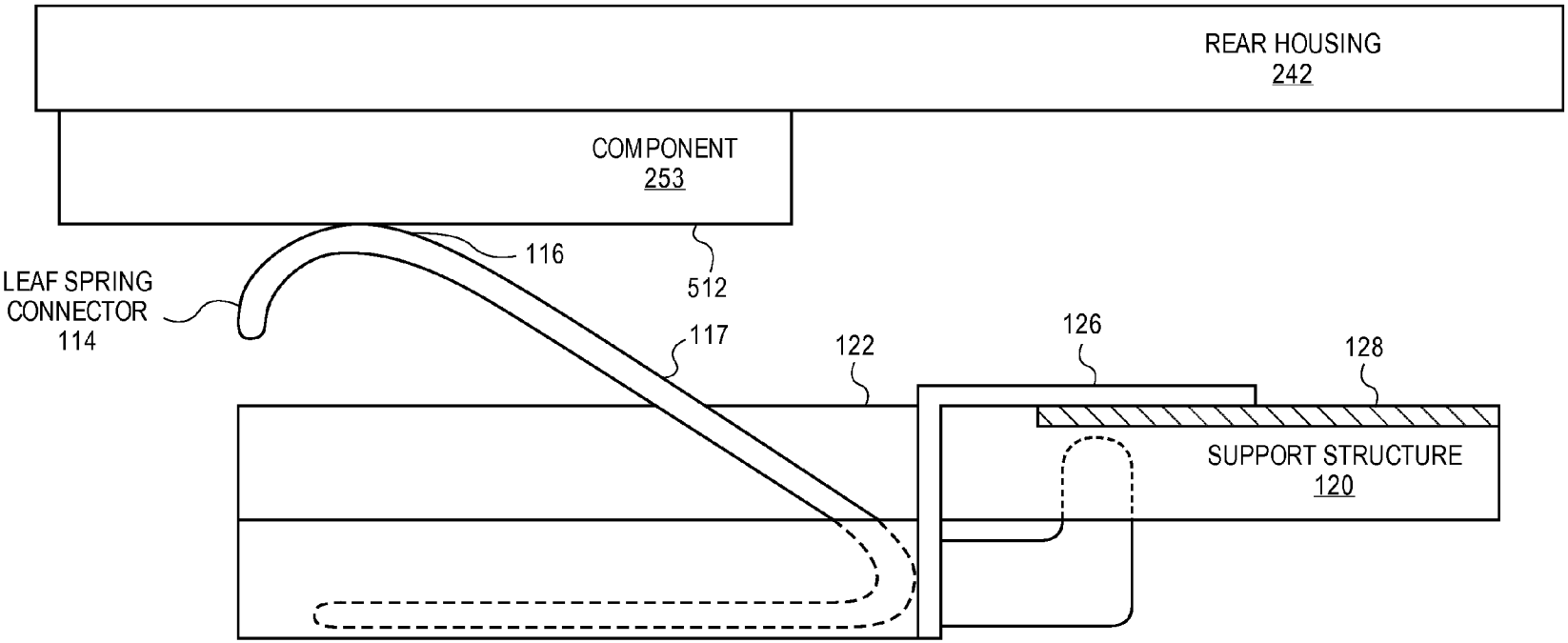
FIG. 5 is block diagram illustrating a cross-sectional view of an under mounted leaf spring connector coupled to an external component, according to an embodiment.

FIG. 5 is block diagram illustrating a cross-sectional view of an under mounted leaf spring connector coupled to an external component, according to an embodiment. In one embodiment, external component 253 is located adjacent to the first side 122 of support structure 120. The external component 253 may be connected to rear housing 242, as shown, or to some other support structure, such as front housing 241, another PCB in electronic device 200 or to some other support structure. In one embodiment, the component 253 may include a battery for storing energy that is used to power the electronic device 200. In other embodiments, the component 253 may another component, such as a speaker, an antenna, a peripheral connector, or some other component.

In one embodiment, one surface 512 of component 253, or at least a portion of the surface 512 includes an electrical contact. When the component 253 is coupled with leaf spring connector 114 (e.g., by closing rear housing 242), the electrical contact on the surface 512 of component 253 may contact mating surface 116 of leaf spring connector 114. The component 253 may place some amount of pressure on leaf spring connector, possibly causing spring arm 117 to deflect slightly towards the first side 122 of support structure 120. Leaf spring connector 114 may in turn apply pressure on component 253. These opposing forces may help to maintain the contact between the surface 512 of component 253 and mating surface 116 of leaf spring connector 114.

In one embodiment, the contact between the surface 512 of component 253 and mating surface 116 of leaf spring connector 114 forms an electrical connection between component 253 and leaf spring connector 114. As described above, leaf spring connector may additionally be connected to housing trace 126 and conductive trace 128 on support structure 120. Conductive trace 128 may in turn be connected to one or more components 251 mounted on support structure 120. Thus, an electrical connection may be formed between component 253 and conductive trace 128 through leaf spring connector 114. Therefore, any electrical signals sent by component 253 may be passed through leaf spring connector 114, housing trace 126, conductive trace 128 and be received by component 251. Similarly, any electrical signals sent by component 251 may be received by component 253.

Figure 6:
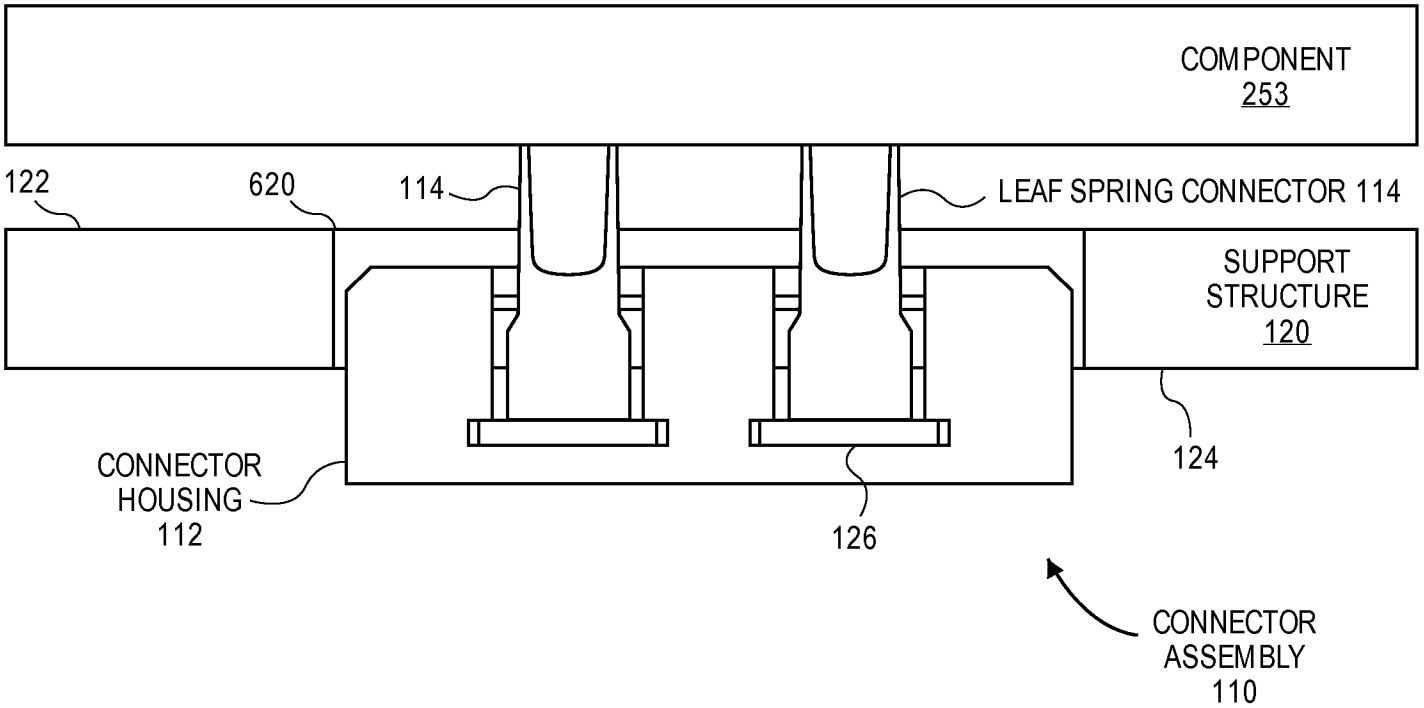
FIG. 6 is a block diagram illustrating an end view of an under mounted leaf spring connector coupled to an external component, according to an embodiment.

FIG. 6 is a block diagram illustrating an end view of an under mounted leaf spring connector coupled to an external component, according to an embodiment. In one embodiment, connector assembly 110 includes connector housing 112 and two leaf spring connectors 114. The connector assembly 110 may be mounted to a support structure 120. In one embodiment, the connector housing 112 is mounted within a notch 620 in support structure 120. The notch 620 may be a hole, void, cavity, space, or opening within support structure 120. In one embodiment, the notch 620 is substantially rectangular in shape. In other embodiments, the notch 620 may have some other shape, such as a circle, oval, square, triangle, or other shape. In one embodiment, the notch 620 is located on an edge of support structure 120, such that notch 620 is bounded by support structure 120 on three sides and open on one side. In another embodiment, notch 620 is located in the middle of support structure 120, such that notch 620 is bounded on all sides by support structure 120. In one embodiment, notch 620 passes all the way through the thickness support structure 120 from the first side 122 to the second side 124. In another embodiment, notch 620 passes only partially through support structure 120.

As illustrated, the leaf spring connector assembly 110 is mounted within the notch 620 of support structure 120. In one embodiment, the connector housing 112 is mounted so that an upper surface of the housing 112 is located between the first side 122 and the second side 124 of support structure 120. In other embodiments, the connector assembly 110 may be mounted in some other fashion. In one embodiment, the leaf spring connectors 114 extend through the notch 620 in the support structure 120 and extend above the first side 122.

In one embodiment, the leaf spring connectors 114 are each connected to a separate housing trace 126. In turn, housing trace 126 may contact conductive traces one either side of or within support structure 120. In other embodiments, each leaf spring connector 114 may be connected to the same housing trace 126. In addition, the leaf spring connectors 114 each contact component 253, thereby forming an electrical connection. Using such electrical connection, electrical signals may be passed between component 253 and other components on support structure 120 via leaf spring connectors 114.

Figure 7:
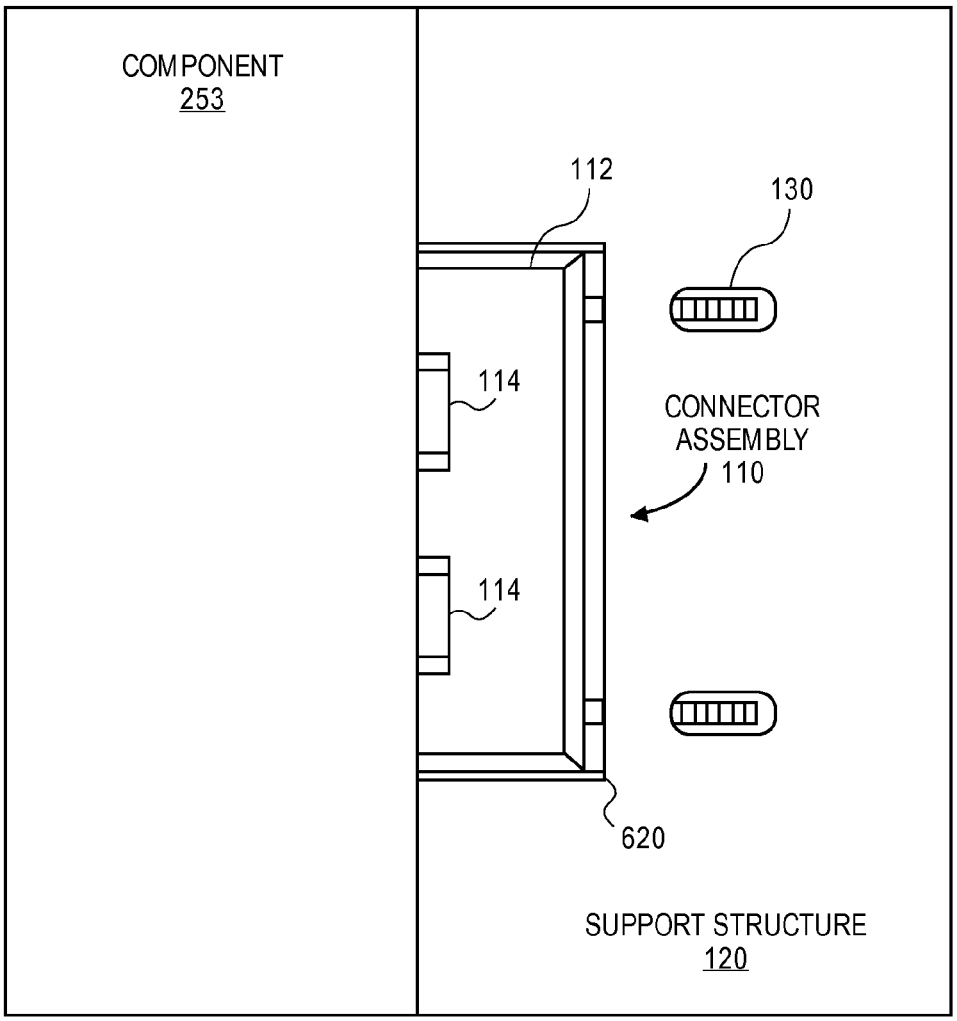
FIG. 7 is a block diagram illustrating a top view of an under mounted leaf spring connector coupled to an external component, according to an embodiment.

FIG. 7 is a block diagram illustrating a top view of an under mounted leaf spring connector coupled to an external component, according to an embodiment. In one embodiment, connector assembly 110 includes connector housing 112 and two leaf spring connectors 114. The connector assembly 110 may be mounted to support structure 120. The connector housing 112 may be mounted within notch 620 in support structure 120. In one embodiment, connector housing 112 is approximately the same shape as notch 620. In other embodiments, connector housing 112 may have a different shape than notch 620.

In the illustrated embodiment, external component 253 is located adjacent to support structure 120. From the viewpoint of FIG. 7, component 253 is located on top of support structure 120 and at least partially on top of connector assembly 110. In one embodiment, the leaf spring connectors 114 each contact component 253, thereby forming an electrical connection. Using such electrical connection, electrical signals may be passed between component 253 and other components on support structure 120 via leaf spring connectors 114.

In one embodiment, connector housing 112 is connected to support structure 120 using one or more mounting elements 130. The mounting elements 130 may be affixed to connector housing 112 and extend at least partially through support structure 120. In one embodiment, mounting elements 130 may extend all the way through support structure 120 as shown. The mounting elements 130, for example, may be metal or plastic posts that are soldered to support structure 120. In other embodiments, the mounting elements 130 may be screws, snap connectors, or some other connector that attaches to support structure 120 to hold connector housing 112 in place.

Figure 8:
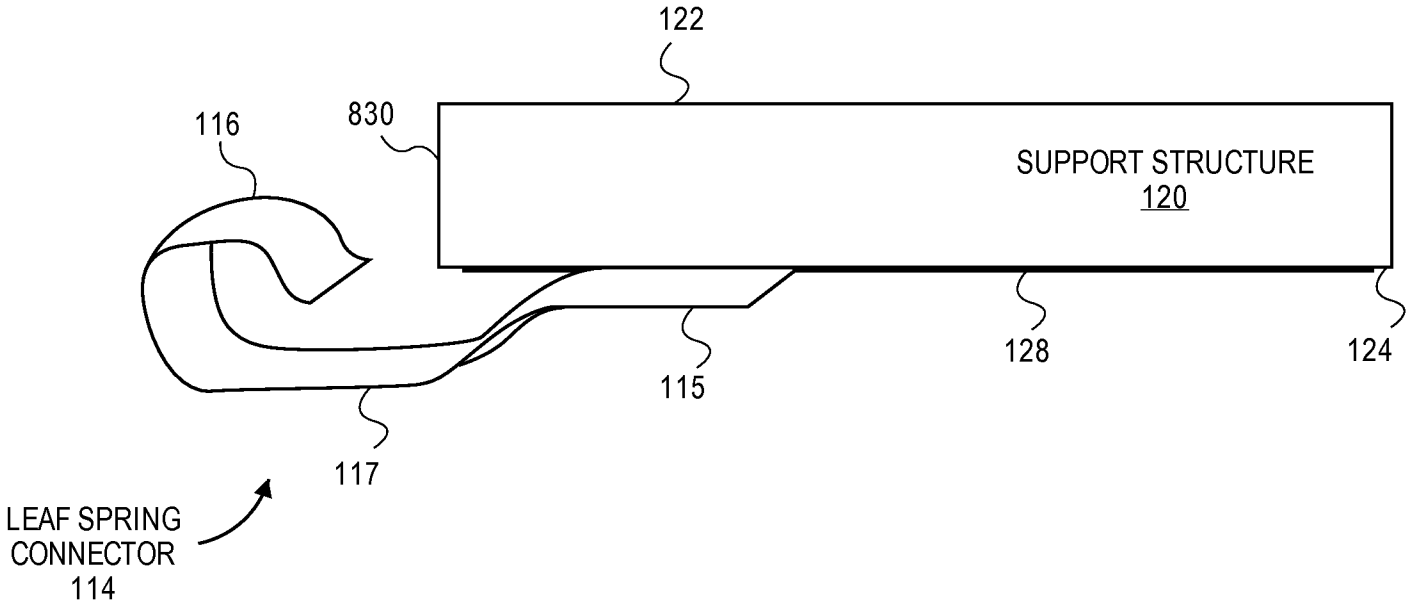
FIG. 8 is a block diagram illustrating a side view of an under mounted leaf spring connector cantilevered off of a support structure, according to an embodiment.

FIG. 8 is a block diagram illustrating a side view of an under mounted leaf spring connector cantilevered off of a support structure, according to an embodiment. In one embodiment, leaf spring connector 114 may be directly connected to support structure 120, without having a connector housing. In one embodiment, the leaf spring connector 114 is formed from a single piece of conductive material, such as stamped sheet metal. The conductive material is shaped to include a support contact surface 115, a mating surface 116 and a curved spring arm 117 to connect support contact surface 115 and mating surface 116. In one embodiment, the support contact surface 115 connects directly to a second side of support structure 120. Support contact surface 115 may also contact conductive trace 128 on the second side 124 of support structure 120. Conductive trace 128 may additionally be coupled to one or more electrical components (not shown) mounted to support structure 120. Thus, conductive trace 128 forms an electrical connection between leaf spring connector 114 and the electrical components.

In one embodiment, curved spring arm 117 extends past an edge 830 of support structure 120, such that at least a portion of leaf spring connector 114 is cantilevered past the edge 830. For example, mating surface 116 may extend past the edge 830 of support structure in order to contact an external component (not shown). In one embodiment, the mating surface 116 is located at a level equal to or above a first side 122 of support structure 120 to contact an external component located adjacent to the first side 122. In other embodiments, the mating surface 116 is located below the level of the first side 122 of support structure 120 to contact an external component located at approximately the same level as support structure 120. In these embodiments, for example, the external located may be located adjacent to the side 830 of support structure 120.

Figure 9:
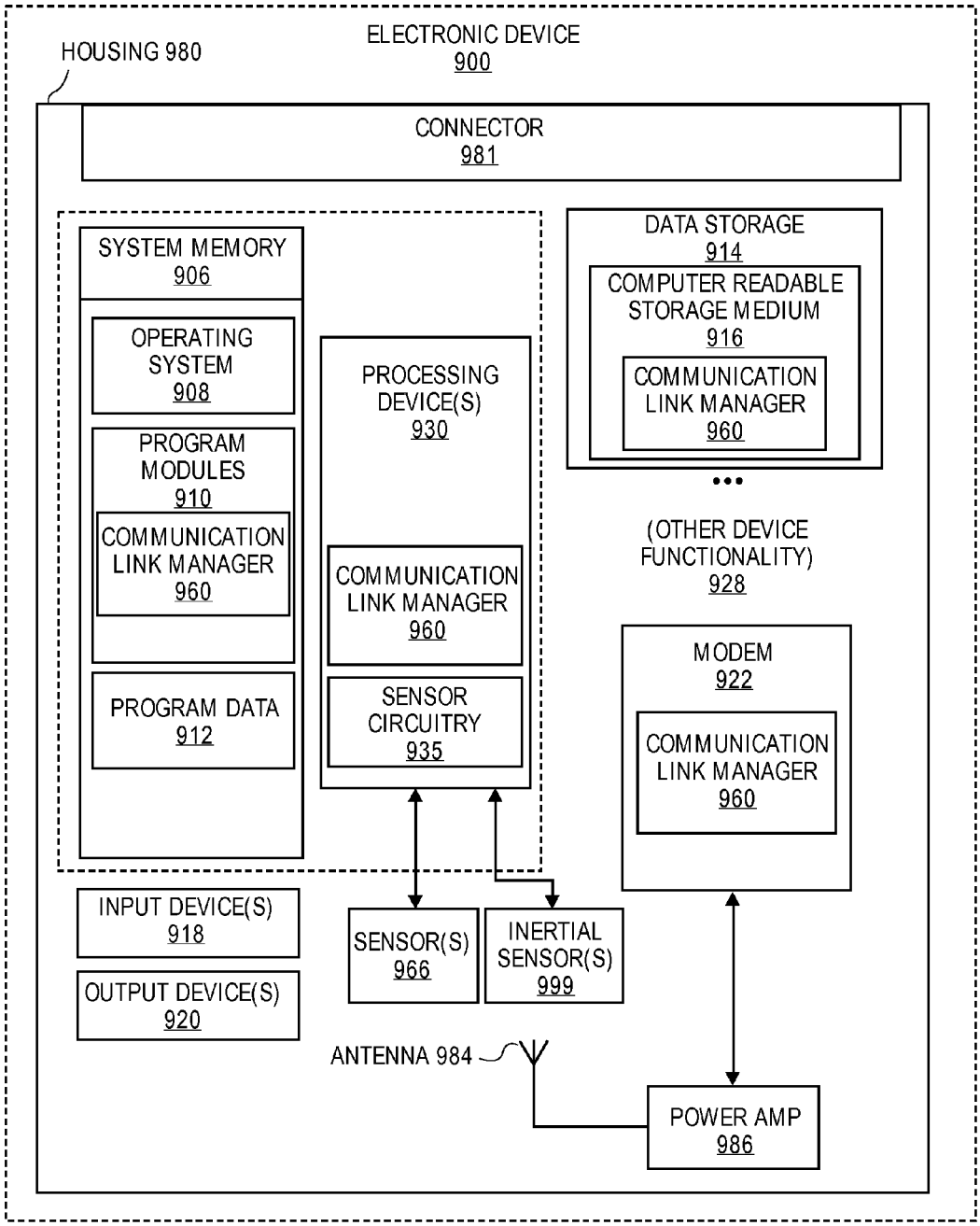
FIG. 9 is a block diagram illustrating an exemplary user device, according to an embodiment.

FIG. 9 illustrates a functional block diagram of an embodiment of an electronic device. The electronic device 900 may correspond to the electronic device 200 of FIGS. 2 and 3 and may be any type of computing device such as an electronic book reader, a PDA, a mobile phone, a laptop computer, a portable media player, a tablet computer, a smart phone, a camera, a video camera, a netbook, a desktop computer, a gaming console, a digital video disc (DVD) player, a computing pad, a media center, and the like.

The electronic device 900 includes one or more processing devices 930, such as one or more central processing units (CPUs), microcontrollers, field programmable gate arrays, or other types of processing devices. The electronic device 900 also includes system memory 906, which may correspond to any combination of volatile and/or non-volatile storage mechanisms. The system memory 906 may include one or more of read-only memory (ROM), flash memory, dynamic random access memory (DRAM) such as synchronous DRAM (SDRAM)), and static random access memory (SRAM)). The system memory 906 stores information which provides an operating system component 908, various program modules 910 such as communication link manager 960, program data 912, and/or other components. The electronic device 900 performs functions by using the processing device(s) 930 to execute instructions provided by the system memory 906.

The electronic device 900 also includes a data storage device 914 that may be composed of one or more types of removable storage and/or one or more types of non-removable storage. The data storage device 914 includes a computer-readable storage medium 916 on which is stored one or more sets of instructions embodying any one or more of the methodologies or functions described herein. As shown, instructions for the communication link manager 960 may reside, completely or at least partially, within the computer readable storage medium 916, system memory 906 and/or within the processing device(s) 930 during execution thereof by the electronic device 900, the system memory 906 and the processing device(s) 930 also constituting computer-readable media. The electronic device 900 may also include one or more input devices 918 (keyboard, mouse device, specialized selection keys, etc.) and one or more output devices 920 (displays, printers, audio output mechanisms, etc.). In one embodiment, the input devices 918 and the output devices 920 may be combined into a single device (e.g., a touch screen).

The electronic device 900 further includes a wireless modem 922 to allow the electronic device 900 to wirelessly communicate with other computing devices. The wireless modem 922 allows the electronic device 900 to handle both voice and non-voice communications (such as communications for text messages, multimedia messages, media downloads, web browsing, etc.). The wireless modem 922 may also allow the electronic device 900 to handle other signaling data to facilitate communication of the voice and non-voice data between the electronic device 900 and other devices. The wireless modem 922 may provide network connectivity using any type of mobile network technology including, for example, cellular digital packet data (CDPD), general packet radio service (GPRS), enhanced data rates for global evolution (EDGE), universal mobile telecommunications system (UMTS), 1 times radio transmission technology (1×RTT), evaluation data optimized (EVDO), high-speed down-link packet access (HSDPA), WiFi, HSPA+, WiMAX, Long Term Evolution (LTE) and LTE Advanced (sometimes generally referred to as 4G), etc. In one embodiment, the wireless modem includes the communication link manager 960 in addition to, or instead of, the communication link manager 960 being included in the computer readable storage medium 916, system memory 906 and/or processing device(s) 930. The communication link manager 960 may be implemented as hardware, firmware and/or software of the wireless modem 922. It should be noted that the modem 922 may include a processing component that performs various operations to handle both voice and non-voice communications. This processing component can execute the communication link manager 960. Alternatively, the communication link manager 960 can be executed by a processing component of the electronic device, such as the processing device 930.

The wireless modem 922 may generate signals and send these signals to power amplifier (amp) 980 for amplification, after which they are wirelessly transmitted via antenna 984. The antenna 984 may be directional, omni-directional or non-directional antennas. In addition to sending data, the antenna 984 can be deployed to receive data, which is sent to wireless modem 922 and transferred to processing device(s) 930. In one embodiment, the antenna 984 may be used to form communication links between the electronic device 900 and a base station (e.g., a NodeB or a cell tower).

The processing device(s) 930 and the modem 922 may be a general-purpose processing devices such as a microprocessor, central processing unit, or the like. More particularly, the processing device(s) 930 and the modem 922 may be a complex instruction set computing (CISC) microprocessor, reduced instruction set computing (RISC) microprocessor, very long instruction word (VLIW) microprocessor, or a processor implementing other instruction sets or processors implementing a combination of instruction sets. The processing device(s) 930 and the modem 922 may also be one or more special-purpose processing devices such as an application specific integrated circuit (ASIC), a field programmable gate array (FPGA), a digital signal processor (DSP), network processor, or the like.

In one embodiment, electronic device 900 includes one or more sensors 966 such as a physical contact sensor or close proximity sensors. The sensors 966 can detect the human body parts proximate to the electronic device, and convey information regarding the detection to processing device(s) 930. In one embodiment, the sensors 966 may be capacitive sensors that are configured to measure capacitance generated by the human body part proximate to the electronic device using any one of various techniques known in the art, for example, relaxation oscillation, a current verses voltage phase shift comparison, resistor-capacitor charge timing, capacitive bridge division, charge transfer, sigma-delta modulation, or charge-accumulation. In an alternative embodiment, the sensors 966 may also be optical (e.g., infrared) sensors that use an emitter and receiver pair to detect the presence of opaque objects. Alternatively, the sensors 966 may be inductive sensors, which include an inductive loop. When the presence of a human body part (or metal object) is brought close to the inductive sensor, an induction of the inductive loop changes, causing the human body part to be detected. Alternatively, the sensors 966 may be ultrasonic sensors that emit an ultrasonic signal and measure a time duration between when a signal is transmitted and the reflection of that signal received (a.k.a., flight response). The sensors 966 may also include other types of sensors, such as those that operate using the detection principles of resistive (e.g., analog resistive, digital resistive or residual resistive), surface acoustic wave, electromagnetic, near field imaging, or other technologies. In one embodiment, multiple different types of sensors are used. It should also be noted that the sensors 966 may be used to determine a distance between one or more of the antennas and the detected human body part. Though the detected object is described herein as a human body part, other types of objects may also be detected depending on the sensing technologies used.

In one embodiment, electronic device 900 includes one or more inertial sensors 999. The inertial sensors 999 can be used to detect motion of the electronic device 900. In one embodiment, the inertial sensors 999 detect linear accelerations (translational movement) and angular accelerations (rotational movement). The inertial sensors 999 may include accelerometers and/or gyroscopes. Gyroscopes use principals of angular momentum to detect changes in orientation (e.g., changes in pitch, roll and twist). Accelerometers measure accelerations along one or more axes (e.g., translational changes). The gyroscope and accelerometer may be separate sensors, or may be combined into a single sensor. The inertial sensors 999 in one embodiment are micro-electromechanical systems (MEMS) sensors.

In one embodiment, the motion data from the one or more inertial sensors 999 may be used to determine an orientation of the electronic device 900 to determine if a communication link criterion is satisfied (e.g., whether the electronic device 900 is in proximity to a user's body). In another embodiment, the sensor data from the one or more sensors 966 may be used to determine an orientation of the electronic device 900 for to determine if a communication link criterion is satisfied. In a further embodiment, of the motion data and the sensor data may be used to determine whether a communication link criterion is satisfied.

The processing device(s) 930 may include sensor circuitry 935 (e.g., sensor device drivers) that enables the processing device(s) 930 to interpret signals received from the sensor(s) 966 and/or inertial sensors 999. In one embodiment, the sensors 966 and/or inertial sensors 999 output fully processed signals to the processing device(s) 930. For example, the sensors 966 may output a distance, a detected/not detected signal, etc. using a single line interface or a multi-line interface. Similarly, inertial sensors 999 may output an acceleration value (e.g., in Gs). In another embodiment, the sensors 966 output, for example, positional data and/or object presence data (e.g., of a human body part) to the processing devices) 930 without first processing the data. Similarly, inertial sensors 999 may output, for example, voltage values that can be interpreted as acceleration values. In either instance, the processing device(s) 930 may use the sensor circuitry 935 to process and/or interpret the received data. If data is received from multiple sensors 966 and/or inertial sensors 999, processing the data may include averaging the data, identifying a maximum from the data, or otherwise combining the data from the multiple sensors. In one embodiment, in which the sensors 966 include a sensor array, numerous sensors, or a touch panel, processing the data includes determining where on the electronic device the human body part is located from multiple sensor readings.

The electronic device 900 may include a housing 980 that houses the various components described above. Electronic device 900 may also include a connector 981, which may be one representation of leaf spring connector assembly 110. The connector 981 may be used to connect various components described above to one another or to connect one or more of these components to another component, such as component 253.

Figure 10:
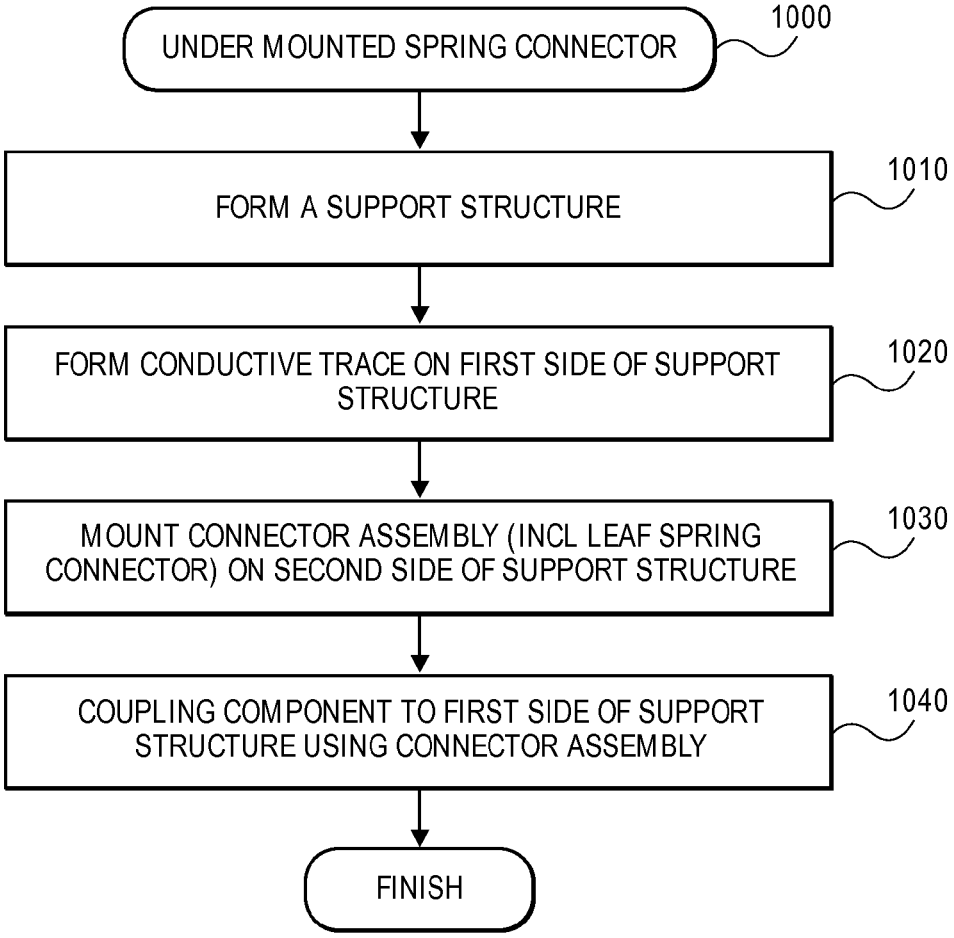
FIG. 10 is a flow diagram illustrating a method for forming a support structure with an under mounted leaf spring connector, according to an embodiment.

FIG. 10 is a flow diagram illustrating a method for forming a support structure with an under mounted leaf spring connector, according to an embodiment. The method 1000 may be performed printed circuit board and integrated circuit manufacturing machinery, including for example, laminating equipment, pattern etching equipment, drilling equipment, plating and coating equipment, soldering equipment, silk-screen equipment, or a combination of this or other machinery.

Referring to FIG. 10, at block 1010, method 1000 forms a support structure 120. In one embodiment, the support structure 120 is a printed circuit board (PCB). In other embodiments, the support structure 120 may be a logic board, a motherboard, an analog board, a substrate, a frame, such as an internal frame or a midframe, or some other support structure. The support structure may be composed of metal, plastic, or a combination of metal and plastic. In other embodiments, the support structure may be other types or composed of other materials.

At block 1020, method 1000 forms a conductive trace 128 on a first side 122 of support structure 120. In one embodiment a copper layer is applied to the laminate material of the PCB. A subtractive process may remove unwanted copper by various methods leaving only the desired copper traces. In an additive method, traces may be electroplated onto a bare substrate. Double-sided boards or multi-layer boards may use plated-through holes, called vias, to connect traces on different layers of the support structure 120.

At block 1030, method 1000 mounts a connector assembly 110, including at least one leaf spring connector 114, on a second side 124 of support structure 120. The second side 124 may be opposite the first side 122, which is where the leaf spring connector 114 is designed to couple to an external component, such as a battery. In one embodiment, the leaf spring connector 114 extends through a notch in the support structure 120 and extends above the first side 122. In another embodiment, the leaf spring connector assembly 110 is mounted at some level below the first side 122 of support structure 120. In other embodiments, the leaf spring connector assembly 110 may be mounted to the first side 122, when the leaf spring connector 114 is intended to couple to an external component adjacent to the opposite second side 124 of support structure 120.

At block 1040, method 1000 couples a component 253 to the first side 122 of support structure 120 using the connector assembly 110. In one embodiment, one surface 512 of component 253, or at least a portion of the surface 512 includes an electrical contact. When the component 253 is coupled with leaf spring connector 114 the electrical contact on the surface 512 of component 253 may contact a mating surface 116 of leaf spring connector 114. The component 253 may place some amount of pressure on leaf spring connector 114, possibly causing spring arm 117 to deflect slightly towards the first side 122 of support structure 120. Leaf spring connector 114 may in turn apply pressure on component 253. These opposing forces may help to maintain the contact between the surface 512 of component 253 and mating surface 116 of leaf spring connector 114. Thus, an electrical connection may be formed between component 253 and conductive trace 128 through leaf spring connector 114. Therefore, any electrical signals sent by component 253 may be passed through leaf spring connector 114, housing trace 126, conductive trace 128 and be received by component 251. Similarly, any electrical signals sent by component 251 may be received by component 253.

The foregoing description sets forth numerous specific details such as examples of specific systems, components, methods, and so forth, in order to provide a good understanding of several embodiments of the present invention. It will be apparent to one skilled in the art, however, that at least some embodiments of the present invention may be practiced without these specific details. In other instances, well-known components or methods are not described in detail or are presented in simple block diagram format in order to avoid unnecessarily obscuring the present invention. Thus, the specific details set forth are merely exemplary. Particular implementations may vary from these exemplary details and still be contemplated to be within the scope of embodiments of the present invention.

In the above description, numerous details are set forth. It will be apparent, however, to one of ordinary skill in the art having the benefit of this disclosure, that embodiments of the present invention may be practiced without these specific details. In some instances, well-known structures and devices are shown in block diagram form, rather than in detail, in order to avoid obscuring the description.

It is to be understood that the above description is intended to be illustrative, and not restrictive. Many other embodiments will be apparent to those of skill in the art upon reading and understanding the above description. The scope of the present invention should, therefore, be determined with reference to the appended claims, along with the full scope of equivalents to which such claims are entitled.

What is claimed is:

1. An electronic device comprising:

a two-sided printed circuit board (PCB) having a conductive trace disposed thereon;

a battery disposed within the electronic device adjacent to a first side of the two-sided PCB, but not mounted to the two-sided PCB; and a connector assembly coupled to the two-sided PCB, wherein the connector assembly comprises:

a connector housing; and a leaf spring connector disposed within the connector housing, wherein the connector housing is mounted to a second side of the two-sided PCB, and wherein the leaf spring connector passes through a notch in the two-sided PCB and extends past the first side of the two-sided PCB to contact the battery on the first side of the two-sided PCB and form an electrical connection between the battery and the conductive trace, wherein the leaf spring connector has a working height measured from the first side of the two-sided PCB to a portion of the leaf spring connector that contacts the battery, and the working height is reduced by a thickness of the two-sided PCB when the connector housing is mounted to the second side of the two-sided PCB.

2. The electronic device of claim 1, wherein the battery is coupled to an interior surface of a device housing of the electronic device.

3. The electronic device of claim 1, wherein the leaf spring connector comprises a single piece of stamped metal having a PCB contact surface to couple to the conductive trace on the two-sided PCB, a mating surface to contact the battery, and a curved spring arm coupled between the PCB contact surface and the mating surface.

4. The electronic device of claim 3, wherein the working height is measured from the first side of the two-sided PCB to the mating surface of the leaf spring connector when the leaf spring connector is in a compressed position.

5. The electronic device of claim 1, wherein the connector assembly comprises a plurality of leaf spring connectors disposed within the connector housing.

6. An apparatus comprising:

a support structure; and a leaf spring connector coupled to the support structure, the leaf spring connector having a working height measured from a first surface of the support structure to a mating surface of the leaf spring connector when the leaf spring connector is in a compressed position, wherein the leaf spring connector is mounted below the first surface of the support structure to reduce the working height by at least a portion of a thickness of the support structure, and wherein the leaf spring connector is coupled to a conductive trace disposed on the support structure.

7. The apparatus of claim 6, further comprising:

an electrical component coupled to an interior surface of a housing of the electronic device, the component to contact the mating surface of the leaf spring connector.

8. The apparatus of claim 7, wherein the leaf spring connector is to form an electrical connection between the component and the conductive trace disposed on the support structure.

9. The apparatus of claim 6, further comprising:

a connector housing, wherein the leaf spring connector is disposed within the connector housing, and wherein the connector housing is mounted to a second surface of the support structure opposite the first surface.

10. The apparatus of claim 6, wherein the leaf spring connector comprises a single piece of stamped metal including a support contact surface to couple to the support structure, the mating surface to contact a component, and a curved spring arm coupled between the support contact surface and the mating surface.

11. The apparatus of claim 10, wherein the support contact surface is coupled to a second surface of the support structure opposite the first surface, and wherein the curved spring arm is cantilevered past an edge of the support structure.

12. The apparatus of claim 11, wherein the support surface contact is coupled to a second surface of the support structure opposite the first surface, and wherein the curved spring arm extends through a notch in the support surface to position the mating surface of the leaf spring connector above the first surface of the support structure.

13. The apparatus of claim 11, wherein the support surface contact is coupled between the first surface and a second surface opposite the first surface of the support structure, wherein the curved spring arm extends through a hole in the support structure to position the mating surface of the leaf spring connector above the first surface of the support structure.

14. A method comprising:

forming a support structure;

forming a conductive trace on a first side of the support structure; and mounting a connector assembly to a second side of the support structure, the connector assembly comprising a connector housing and a leaf spring connector, wherein the leaf spring connector passes through a notch in the support structure and extends past the first side of the support structure.

15. The method of claim 14, further comprising:

coupling a component to the first side of the support structure using the connector assembly, wherein the leaf spring connector forms an electrical connection between the component and the conductive trace.

16. The method of claim 14, wherein forming the support structure comprises layering a non-conductive substrate and conductive traces to form a printed circuit board (PCB).

17. The method of claim 14, wherein the leaf spring connector comprises a single piece of stamped metal including a support contact surface to couple to the conductive trace on the support structure, a mating surface to contact the component, and a curved spring arm coupled between the support contact surface and the mating surface.

18. The method of claim 17, wherein the leaf spring connector has a working height measured from the first side of the support structure to the mating surface of the leaf spring connector when the leaf spring connector is in a compressed position, and wherein mounting the connector assembly to the second side of the support structure reduces the working height by a thickness of the support structure.

19. The method of claim 14, wherein the second side of the support structure is opposite the first side of the support structure.

20. The method of claim 14, further comprising:

mounting the connector assembly in an opening in the support structure between the first side and the second side, wherein the leaf spring connector passes through the opening in the support structure.

* * * * *